US012577643B2

(12) United States Patent
Izawa et al.

(10) Patent No.: US 12,577,643 B2
(45) Date of Patent: Mar. 17, 2026

(54) SLIDING MEMBER AND INTERNAL COMBUSTION ENGINE PROVIDED WITH SLIDING MEMBER

(71) Applicants: Nissan Motor Co., Ltd., Yokohama (JP); Fukuda Metal Foil & Powder Co., Ltd., Kyoto (JP)

(72) Inventors: Yoshinori Izawa, Kanagawa (JP); Katsunori Otobe, Kyoto (JP)

(73) Assignees: Nissan Motor Co., Ltd., Yokohama (JP); Fukuda Metal Foil & Powder Co., Ltd., Kyoto (JP)

( * ) Notice: Subject to any disclaimer, the term of this patent is extended or adjusted under 35 U.S.C. 154(b) by 40 days.

(21) Appl. No.: 18/848,145

(22) PCT Filed: Dec. 13, 2022

(86) PCT No.: PCT/JP2022/045862
§ 371 (c)(1),
(2) Date: Sep. 18, 2024

(87) PCT Pub. No.: WO2023/188576
PCT Pub. Date: Oct. 5, 2023

(65) Prior Publication Data

US 2025/0243572 A1 Jul. 31, 2025

(30) Foreign Application Priority Data

Mar. 28, 2022 (JP) ..... 2022-051584

(51) Int. Cl.
*C22C 29/18* (2006.01)
*C22C 29/00* (2006.01)
(Continued)

(52) U.S. Cl.
CPC ..... *C22C 38/12* (2013.01); *C22C 29/005* (2013.01); *C22C 29/18* (2013.01); *C22C 30/00* (2013.01);
(Continued)

(58) Field of Classification Search
CPC ..... C22C 29/005; C22C 29/18
See application file for complete search history.

(56) References Cited

U.S. PATENT DOCUMENTS

| | | | |
|---|---|---|---|
| 6,562,098 | B1 | 5/2003 | Fujitsuka et al. |
| 7,575,619 | B2 | 8/2009 | Kawata et al. |
| 2011/0146448 | A1 | 6/2011 | Fujitsuka et al. |

FOREIGN PATENT DOCUMENTS

| | | | |
|---|---|---|---|
| JP | 3852764 | B2 | 12/2006 |
| JP | 2008-279463 | A | 11/2008 |
| JP | 6940801 | B1 | 9/2021 |

OTHER PUBLICATIONS

Liu et al., Microstructure and thermal stability of MoSi2-CoNiCrAlY nanocomposite feedstock prepared by high energy ball milling, Surface & Coatings Technology, 239 (2014) 78-83. (Year: 2014).*

(Continued)

*Primary Examiner* — Adam Krupicka
(74) *Attorney, Agent, or Firm* — Spencer Fane LLP

(57) ABSTRACT

A sliding member includes at least one surface having a particle aggregate of base material particles and hard particles. The hard particles are iron-based alloy particles containing molybdenum silicide in an amount of 35% to 90% by area. The sliding member has a wear resistance equivalent to that of a sliding member that uses cobalt-based hard particles.

10 Claims, 1 Drawing Sheet

SOURCE: Fe-Mo BINARY PHASE DIAGRAM (ASM International Diagram No. 101126)

(51) Int. Cl.

| | |
|---|---|
| ***C22C 30/00*** | (2006.01) |
| ***C22C 38/02*** | (2006.01) |
| ***C22C 38/12*** | (2006.01) |
| ***C23C 24/08*** | (2006.01) |
| ***F01L 3/04*** | (2006.01) |

(52) U.S. Cl.
CPC ..... *C22C 38/02* (2013.01); *C23C 24/085* (2013.01); *F01L 3/04* (2013.01)

(56) References Cited

OTHER PUBLICATIONS

Extended European Search Report received for EP Application No. 22935705.8, mailed on Jul. 8, 2025, 10 pages.

* cited by examiner

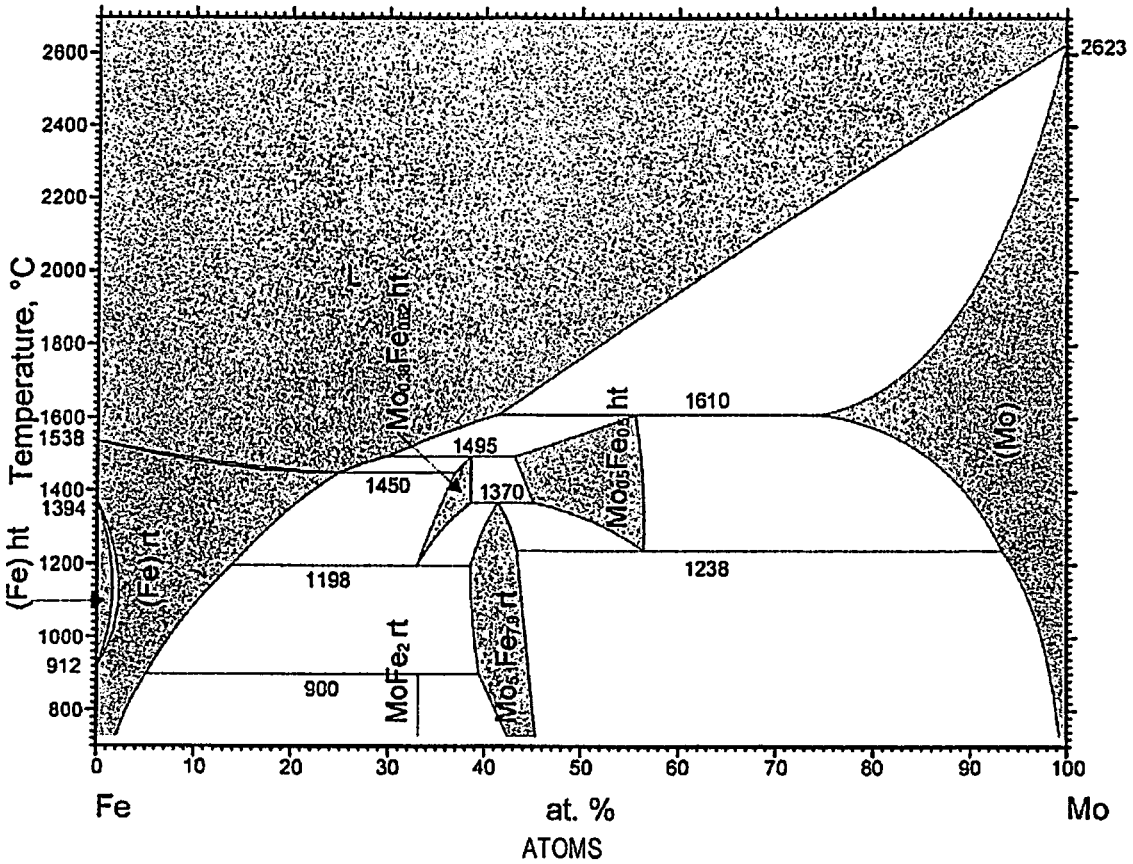
SOURCE: Fe-Mo BINARY PHASE DIAGRAM (ASM International Diagram No. 101126)

SLIDING MEMBER AND INTERNAL COMBUSTION ENGINE PROVIDED WITH SLIDING MEMBER

CROSS-REFERENCE TO RELATED APPLICATIONS

This application is a U.S. national stage application of International Application No. PCT/JP2022/045862, filed on Dec. 13, 2022.

BACKGROUND

Technical Field

The present invention relates to a sliding member, and more specifically relates to a sliding member provided with a particle aggregate in which hard particles are dispersed among particles in a base material particle phase, and an internal combustion engine provided with said sliding member.

Background Information

In order to adapt to increasing performance and power output in automobile engines, components that require wear resistance at high temperatures, such as valve seats, generally have cobalt-based hard particles having a hard phase added to a base material particle phase, whereby performance requirements such as the above-mentioned wear resistance are satisfied.

The above-mentioned cobalt-based hard particles are expensive and have become difficult to obtain in recent years; accordingly, there has been a demand for a sliding member that has wear resistance up to high temperatures without using cobalt.

Japan Patent No. 3852764 (hereinafter referred to as Patent Citation 1) indicates that, as an alternative material to cobalt-based hard particles having a hard phase, hard particles in which a hard phase of molybdenum silicide is dispersed in an iron-based alloy matrix in a concentration of 3 to 30% by area, and a sintered alloy of mixed powder containing the hard particles are used, thereby improving the wear resistance of a sliding member.

SUMMARY

However, in the invention described in Patent Citation 1, wear resistance equivalent to that of a sliding member that uses cobalt-based hard particles having a hard phase is not obtained, leaving room for improvement.

The present invention was devised in view of such problems with the prior art, it being an object of the invention to provide a sliding member that, without using cobalt-based hard particles having a hard phase, has wear resistance equivalent to that of the prior art in which cobalt-based hard particles are used.

As a result of earnest research into achieving the above object, the inventors perfected the present invention upon discovering that the above object can be achieved by using hard particles of an iron-based alloy containing 35 to 90% by area (inclusive) of molybdenum silicide.

Specifically, a sliding member of the present invention comprises at least one surface having a particle aggregate of base material particles and hard particles. The sliding member is characterized in that the hard particles are iron-based alloy particles containing molybdenum silicide in an amount of 35% to 90% by area.

An internal combustion engine of the present invention is characterized by being provided with the sliding member described above.

According to the present invention, it is possible to provide a sliding member having wear resistance equivalent to that of a sliding member that uses cobalt-based hard particles having a hard phase, because hard particles of an iron-based alloy containing a desired amount of molybdenum silicide are used.

BRIEF DESCRIPTION OF THE DRAWINGS

Referring now to the attached drawing which forms a part of this original disclosure, a selected FIGURE is illustrated.

FIG. 1 is a Fe—Mo state diagram. $MoFe_2$ is a Laves phase, $Mo_{5.1}Fe_{7.9}$ is a μ phase, and $Mo_{0.38}Fe_{0.62}$ is an R phase.

DETAILED DESCRIPTION OF EMBODIMENTS

A sliding member of the present invention shall be described in detail. In the sliding member of the present invention, a particle aggregate of base material particles and hard particles is provided at least on a surface, and the hard particles are iron-based alloy particles containing 35 to 90% by area (inclusive) of molybdenum silicide.

In the present invention, "particle aggregate" means an aggregate in which particles are not completely melted but the particle surfaces are partially softened or melted, and adjacent particles are solidified and bonded to each other to become integrated. The sliding member of the present invention may be formed entirely of the above particle aggregate, or may have a coating film formed of the above particle aggregate on a substrate surface.

The above particle aggregate improves wear resistance of the sliding member due to hard particles being disposed among groups of base material particles.

Hard Particles

In the particle aggregate of the present invention, the hard particles are iron-based alloy particles, and the iron-based alloy particles contain hard molybdenum silicide. The iron-based alloy particles have a molybdenum silicide content of 35 to 90% by area (inclusive), and since the molybdenum silicide content is high, wear resistance equivalent to that of hard particles containing cobalt can be expressed.

If the molybdenum silicide content is less than 35% by area, the hard particles will not have sufficient hardness, and if the molybdenum silicide content exceeds 90% by area, the silicon (Si) content of the hard particles will be so high that the toughness of the hard particles themselves will decrease and the particles will become brittle, resulting in reduced wear resistance.

The hard particles of the iron-based alloy contain, in order from the most abundant element, iron (Fe) as a first element, molybdenum (Mo) as a second element, and silicon (Si) as a third element, and it is preferable that the silicon content is 2.3 to 16% by mass (inclusive).

When the silicon content is 2.3% by mass or greater, molybdenum silicide more readily precipitates in the hard particles, increasing the hardness of the hard particles, and when the silicon content is 16% by mass or less, a decrease in the toughness of the hard particles can be prevented.

The molybdenum silicide preferably contains a Laves phase ($Mo(Fe,Si)_2$ or Mo(Fe, Si), where (Fe, Si) may contain the 4th or lower metallic element). The Laves phase is a metastable phase that decomposes at a relatively low temperature of about 900° C., and is therefore oxidized when exposed to a sliding surface in an internal combustion engine, such as the surface of a valve seat, thus forming molybdenum oxide having lubricating properties and improving wear resistance.

The hard particles preferably have a Laves-phase molybdenum silicide (hereinafter simply referred to as "Laves phase") content of 2.0 to 90% by area (inclusive), more preferably 10 to 85% by area (inclusive), and more preferably 30 to 80% by area (inclusive).

The molybdenum silicide in the hard particles may be entirely Laves phase, and an upper limit of the Laves phase content in the hard particles is therefore 90% by area.

Hard particles containing the Laves phase can be formed by melting and homogenizing an iron-based alloy that is mainly composed of iron (Fe) and also contains molybdenum (Mo) and silicon (Si), and then causing molybdenum silicide to precipitate.

Molybdenum silicide forms a u phase and R phase in addition to the Laves phase, as shown in the Fe—Mo state diagram of FIG. 1. The Laves phase precipitates at a lower temperature than the μ-phase and R-phase molybdenum silicides, so the cooling rate must be appropriately adjusted to form the Laves phase.

Specifically, the Laves phase can be formed by melting an iron-based alloy having the above composition, slowly cooling the melted alloy, and crushing the resulting cast piece, or by water atomization or gas atomization in which water or gas is sprayed onto a molten iron-based alloy to form fine droplets that are then solidified into particles, but it is preferable to manufacture the Laves phase by water atomization or gas atomization.

In the hard particles obtained by crushing the cast piece of the above iron-based alloy, a Laves phase is formed due to the slow cooling rate during manufacture of the cast piece. However, since the precipitate of molybdenum silicide tends to become coarse, the hardness of the hard particles obtained by crushing and the molybdenum silicide content tend to vary.

In addition, water atomization and gas atomization are generally used to confine components dissolved in a parent phase metal as a solid solution in the parent phase without causing the components to precipitate, by rapidly cooling and solidifying the molten metal, so that a Laves phase is not formed under normal conditions.

In the water atomization and gas atomization performed in the present invention, the pressure of the water or gas sprayed onto the molten metal, the dripping speed of the molten metal, the size of the droplets, etc., are adjusted, and the cooling rate is made slower than in the usual atomization method, so that hard particles in which the Laves phase precipitates can be formed.

Specifically, depending on the composition of the iron-based alloy, particularly the silicon content, molybdenum silicide having a crystallite size of 0.1 to 3 μm precipitates out by cooling at $10^4$ to $10^2$ K/sec, and hard particles having uniform hardness, in which the molybdenum silicide is finely dispersed, can be formed.

A mesh size of a sieving mesh for adjusting the particle size of the hard particles is preferably adjusted to 100 to 500 (inclusive). In particular, when the particle aggregate is produced using a sintered alloy (described hereinafter), it is desirable to adjust the mesh size of the sieving mesh to 100 to 150 (inclusive), and when the particle aggregate is formed by cold spraying, it is desirable to adjust the mesh size of the sieving mesh to 350 to 500 (inclusive). By increasing the mesh size of the sieving mesh and reducing the particle size of the hard particles, a dense particle aggregate can be formed.

Base Material Particles

As the base material particles, metal or alloy particles that in the prior art have been used in components that require wear resistance at high temperatures, such as valve seats, can be used, but copper-based alloy particles or iron-based alloy particles containing copper (Cu) or iron (Fe) as the main component (50% by mass or greater) are preferred.

With copper-based alloy particles, a heat transfer path is formed by copper, which has high thermal conductivity, and the thermal conductivity of the particle aggregate is increased, improving cooling performance. Therefore, heat resistance improves as a result.

Examples of copper-based alloy particles include Cu—Ni—Si alloy particles, Cu—Cr alloy particles, Cu—Zr alloy particles, Cu—Ti alloy particles, etc., with Cu—Ni—Si alloy particles being particularly preferred.

In Cu—Ni—Si alloy particles, nickel readily bonds with silicon and precipitates. Therefore, a structure in which nickel silicide precipitates in a parent phase is formed, the precipitation is strengthened, the hardness of the parent material particles increases, and wear resistance can be improved in combination with the hard particles.

As the iron-based alloy particles, Fe—Mo alloy particles, Fe—Cr alloy particles, high-speed steel such as SKH53, etc., can be used. It is also possible to use pure Fe particles, which are mixed with graphite particles, and the mixture is sintered, whereby C is dispersed and an Fe—C alloy forms.

If the copper-based alloy particles and the iron-based alloy particles are solid solution particles, when a particle aggregate is formed by cold spraying (described hereinafter), the particles firmly bond to each other and undergo precipitation hardening, thereby further improving the wear resistance.

The solid solution particles can be manufactured by water atomization or gas atomization.

An average particle size (D50) of the matrix particles is preferably 20 to 40 μm. The average particle size of the particles was measured by laser diffraction/scattering using a MT3000 made by MicrotracBEL Corp.

Method for Manufacturing Sliding Member

The sliding member can be manufactured by coating a substrate surface with a particle aggregate by cold spraying, warm spraying, etc., in which raw material particles including the base material particles and hard particles are sprayed onto the substrate surface in a non-molten state, or by press-molding and sintering the raw material particles.

When the sliding member is manufactured by press-molding and sintering raw material particles, the hard particle content of the raw material particles is preferably 50% by area or less, and when the substrate surface is coated by cold spraying, etc., the hard particle content in the particle aggregate is preferably 20% by area or less. Within these ranges, hardness, strength and cooling properties are all achieved, and wear resistance can be improved.

Cold Spraying

Cold spraying is a method of forming a coating layer of a particle aggregate by colliding raw material particles with a substrate while in a non-molten solid state in a supersonic flow together with an inert gas, without being melted or gasified.

Unlike thermal spraying and other methods in which raw material particles are melted and integrated, cold spraying can prevent the properties of the raw material particles from changing due to heat, making it possible to form a coating layer of a particle aggregate without changing the molybdenum silicide in the hard particles.

When the base material particles are solid solution particles, the base material particles in a solid phase state have not yet been precipitation-hardened before colliding with the substrate, and the parent material (substrate) particles therefore undergo plastic deformation to absorb the stress of the collision, preventing the hard particles from cracking or bouncing off.

Inside the base material particles, the dissolved components precipitate due to the energy of the collision to form crystallites having diameters of 5 to 50 nm, and the base material particles become precipitation-hardened copper-based alloy particles or iron-based alloy particles; therefore, wear resistance improves.

Due to the raw material particle collisions, part of the kinetic energy is converted into thermal energy, and the surfaces of the raw material particles melt and solidify locally, whereby the raw material particles bond together to form a particle aggregate in which hard particles are dispersed among groups of base material particles.

At this time, because the surfaces of the raw material particles melt locally, diffusion occurs and precipitates such as intermetallic compounds form. However, since temperatures of the substrate and raw material particles are no higher than a melting point of the raw material particles, the locally melted parts are rapidly cooled; accordingly, there is no time for the precipitates to grow into crystals.

Therefore, nanocrystals or amorphous structures are formed near bonding interfaces between the substrate and the particles, or near bonding interfaces between the particles.

Amorphous and crystalline structures at the interfaces between particles can be confirmed by projecting a diffraction pattern onto a detector surface using electron backscatter diffraction (EBSD), which is performed using a scanning electron microscope (SEM) and analyzing a crystal orientation from the projected pattern.

The raw material particles including the base material particles and hard particles are preferably sprayed at a velocity of 300 to 1200 m/s, and more preferably 500 to 1200 m/s.

A working gas that sprays the raw material particles is preferably at a pressure of 2 to 7 MPa, and more preferably 3.5 to 7 MPa. If the pressure of the working gas is less than 2 MPa, the particle velocity cannot be obtained, and porosity may increase.

A temperature of the working gas depends on a type and particle size of the raw material particles, but is preferably 400 to 1000° C., and more preferably 600 to 1000° C. If the temperature of the working gas is less than 400° C., the raw material particles may tend not to plastically deform, the porosity may increase, and the wear resistance may decrease. In addition, if the temperature of the working gas exceeds 1000° C., the temperature will become too close to the melting point of the raw material particles, and a throat of a spray nozzle will readily become clogged.

Examples of the working gas include nitrogen gas, helium gas, etc.; these examples may be used alone or in a mixture.

A thickness of the coating film depends on a temperature and sliding environment of the location where the sliding member is used; e.g., the thickness is preferably 0.05 to 5.0 mm, and more preferably 0.1 to 1.0 mm.

If the thickness is less than 0.05 mm, the coating film will have insufficient strength, and there may be a risk of plastic deformation occurring when substrate strength is low. If the thickness exceeds 5.0 mm, there may be a risk that the coating film will readily peel due to a relationship between residual stress and interfacial adhesion occurring when the coating film is formed.

There are no particular limitations on the substrate; metals that have been used in the prior art as sliding members in internal combustion engines can be used, but aluminum alloys have high thermal conductivity and are preferred.

Examples of the aluminum alloys include AC2A, AC8A, AC4CH, ADC12, etc., which are specified by the Japanese Industrial Standards.

Sintering

For the sintering method, the base material particles and the hard particles can be press-molded and sintered at a temperature at or below the melting points of the base material particles and the hard particles, thereby forming the sliding member.

Particle Aggregate

The particle aggregate preferably has a porosity of 20% by area or less, more preferably 4% by area or less, and even more preferably 1% by area or less. Particle aggregate strength improves due to the particle aggregate having few pores and being dense, and the wear resistance of the sliding member improves.

The porosity of the particle aggregate and the area ratio of the base material particles and hard particles can be calculated by binarizing a scanning electron microscope image (SEM image) through image processing, and analyzing the image.

The sliding member described above has excellent wear resistance at high temperatures and can therefore be suitably used for sliding members such as, for example, valve seats, valve lifters, pistons, piston rings, piston pins, cylinders, crankshafts, camshafts, and connecting rods of internal combustion engines.

EXAMPLES

The present invention is described in detail below through examples, but the present invention is not limited to the examples below.

Cold Spraying

The hard particles and solid-solution base material particles shown in table 1 below were cold sprayed under the following conditions to form a coating layer on a surface of a valve-seat-shaped substrate, and then finish processing was performed to manufacture a sliding member.

Cold spraying device: PCS-1000 made by Plasma Giken Co., Ltd.

Working gas: nitrogen

Working gas temperature: 600 to 1000° C.

Working gas pressure: 4 to 7 MPa

Spray distance: 20 to 35 mm

Sintering

The hard particles and solid-solution base material particles shown in table 1 below were compression-molded at a molding pressure of 6.5 ton/cm$^2$ into a valve seat shape having an outer diameter of 30 mm, an inner diameter of 22 mm, and a height of 8 mm. The molded body was sintered in ammonia decomposition gas at 1130° C. for 60 minutes and then machined to manufacture a sliding member.

Evaluation

The sliding member was evaluated using the following method. Evaluation results are shown in table 1 along with manufacturing conditions.

Wear Test

Test Conditions

Test method: impact wear test on valve seat unit (test device: made by Takachiho-Seiki Co., Ltd.)

Test temperature: 300° C.

Number of seatings: 1.44 million (3000 cpm×8 hr) Counterpart material (valve): JIS SUH35

Evaluated category: amount of wear on valve seat and valve face (shape measurement)

Molybdenum Silicide in Hard Particles

Analysis method: A phase ratio of molybdenum silicide was measured using X-ray diffraction (XRD).

A crystal structure was identified from a distribution of diffraction angle peaks, and an abundance ratio (percentage by mass, percentage by volume) of each phase was calculated from a magnitude of the peaks. The percentage by volume is, needless to say, equivalent to the percentage by area.

Analysis device: Horizontal X-ray diffraction device SmartLab made by Rigaku Corporation Detector: 2-dimensional detector (HyPix 3000)

After the ratio of each phase was measured using the above method, the Laves phase, μ phase, R phase, other silicides, and parent phase were identified using STEM+EDX and nanodiffraction within a radius of several nanometers to obtain a percentage of each phase.

Porosity

A cross section of the particle aggregate was imaged in five fields of view as a SEM composition image 350 μm wide and 263 μm long, and the images were binarized using an image processing device to calculate the porosity. In addition, an area ratio of the hard particles was calculated from the images, and an area ratio of the base material particles was obtained as a remainder.

TABLE 1

| | | | | Comp. ex. 1 | Comp. ex. 2 | Comp. ex. 3 |
|---|---|---|---|---|---|---|
| Base mat. part. | composition (wt %) | | | Cu—3Ni—0.7Si | Cu—3Ni—0.7Si | Fe—3Mo |
| Hard particles | composition (wt %) | | | Fe—6.3W—5Mo—4.1Cr—2V—0.85C (SKH51) | Fe—35Mo—1.4Si | Fe—35Mo—3Si |
| | manufacturing method | | | water atomization | water atomization | water atomization |
| | cooling rate (K/sec) | | | $\sim 10^4$ | $\sim 10^4$ | $\sim 10^5$ |
| | particle size | | | −500 mesh | −350 mesh | −350 mesh |
| | percentage of parent phase | mass ratio (%) | | 100 | 96.1 | 84.8 |
| | | vol./area rat. (%) | | 100 | 96.7 | 86.2 |
| | percentage of $MoSi_2$ | mass ratio (%) | | 0 | 3.9 | 15.2 |
| | | vol./area rat. (%) | | 0 | 3.3 | 13.8 |
| | $MoSi_2$ breakdown | Laves phase % | mass ratio (%) | 0 | 0 | 0 |
| | | | vol./area rat. (%) | 0 | 0 | 0 |
| | | μ phase % | mass ratio (%) | 0 | 3.9 | 15.2 |
| | | | vol./area rat. (%) | 0 | 3.3 | 13.8 |
| | | R phase and other silicides % | mass ratio (%) | 0 | 0 | 0 |
| | | | vol./area rat. (%) | 0 | 0 | 0 |
| Particle aggregate | manufacturing method | | | cold spraying | cold spraying | cold spraying |
| | base mat. particles | area ratio (%) | | 89.0 | 83.7 | 83.5 |
| | hard particles | area ratio (%) | | 10.8 | 16.0 | 15.8 |
| | pores | area ratio (%) | | 0.2 | 0.3 | 0.7 |
| Wear test | valve seat wear amount (μm) | | | 207 | 112 | 118 |
| | valve face wear amount (μm) | | | 9.6 | 5.1 | 6.2 |
| | Remarks | | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | | |

| | | | Comp. ex. 4 | Comp. ex. 5 |
|---|---|---|---|---|
| Base mat. part. | composition (wt %) | | Fe—3Mo | Cu—3Ni—0.7Si |
| Hard particles | composition (wt %) | | Fe—35Mo—1.4Si | Fe—35Mo—2.0Si |
| | manufacturing method | | crushing | gas atomization |
| | cooling rate (K/sec) | | $10^{-1}$ to $10^0$ | $\sim 10^2$ |
| | particle size | | −100 mesh | −350 mesh |
| | percentage of parent phase | mass ratio (%) | 70.5 | 62.6 |
| | | vol./area rat. (%) | 71.0 | 65.3 |

TABLE 1-continued

| | | | | | |
|---|---|---|---|---|---|
| | percentage of $MoSi_2$ | | mass ratio (%) | 29.5 | 37.4 |
| | | | vol./area rat. (%) | 29.0 | 34.6 |
| | $MoSi_2$ breakdown | Laves phase % | mass ratio (%) | 0 | 0 |
| | | | vol./area rat. (%) | 0 | 0 |
| | | μ phase % | mass ratio (%) | 29.5 | 26.1 |
| | | | vol./area rat. (%) | 29.0 | 23.8 |
| | | R phase and other silicides % | mass ratio (%) | 0 | 11.3 |
| | | | vol./area rat. (%) | 0 | 10.8 |
| Particle aggregate | manufacturing method | | | sintering | cold spraying |
| | base mat. particles | | area ratio (%) | 84.0* | 85.1 |
| | hard particles | | area ratio (%) | | 14.7 |
| | pores | | area ratio (%) | 16.0 | 0.2 |
| Wear test | valve seat wear amount (μm) | | | 105 | 102 |
| | valve face wear amount (μm) | | | 4.4 | 5.5 |
| | Remarks | | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | |

| | | | | Comp. ex. 6 | Comp. ex. 7 |
|---|---|---|---|---|---|
| Base mat. part. | composition (wt %) | | | Cu—3Ni—0.7Si | Fe—3Mo |
| Hard particles | composition (wt %) | | | Co—28Mo8Cr—2.5Si (Tribaloy T-400) | Co—28Mo—8Cr—2.5Si Tribaloy T-400) |
| | manufacturing method | | | water atomization | crushing |
| | cooling rate (K/sec) | | | $\sim 10^4$ | $10^{-1}$ to $10^0$ |
| | particle size | | | −350 mesh | −100 mesh |
| | percentage of parent phase | | mass ratio (%) | 79.2 | 78.8 |
| | | | vol./area rat. (%) | 81.1 | 79/9 |
| | percentage of $MoSi_2$ | | mass ratio (%) | 20.8 | 21.2 |
| | | | vol./area rat. (%) | 18.9 | 20.1 |
| | $MoSi_2$ breakdown | Laves phase % | mass ratio (%) | 20.8 | 21.2 |
| | | | vol./area rat. (%) | 18.9 | 20.1 |
| | | μ phase % | mass ratio (%) | — | — |
| | | | vol./area rat. (%) | — | — |
| | | R phase and other silicides % | mass ratio (%) | — | — |
| | | | vol./area rat. (%) | — | — |
| Particle aggregate | manufacturing method | | | cold spraying | sintering |
| | base mat. particles | | area ratio (%) | 83.8 | 81.8* |
| | hard particles | | area ratio (%) | 16.0 | |
| | pores | | area ratio (%) | 0.2 | 18.2 |
| Wear test | valve seat wear amount (μm) | | | 53.5 | 57.2 |
| | valve face wear amount (μm) | | | 2.3 | 1.9 |
| | Remarks | | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | |

TABLE 2

| | | | Example 1 | Example 2 | Example 3 |
|---|---|---|---|---|---|
| Base mat. part. | composition (wt %) | | Cu—3Ni—0.7Si | Cu—3Ni—0.7Si | Cu—3Ni—0.7Si |
| Hard particles | composition (wt %) | | Fe35Mo—3Si | Fe—35Mo—3Si | Fe—35Mo—3Si |
| | manufacturing method | | water atomization | water atomization | water atomization |
| | cooling rate (K/sec) | | ~$10^4$ | ~$10^4$ | ~$10^4$ |
| | particle size | | −350 mesh | −350 mesh | −500 mesh |
| | percentage of parent phase | mass ratio (%) | 48.1 | 48.1 | 39.3 |
| | | vol./area rat. (%) | 46.0 | 46.0 | 35.1 |
| | percentage of $MoSi_2$ | mass ratio (%) | 51.9 | 51.9 | 60.7 |
| | | vol./area rat. (%) | 54.0 | 54.0 | 65.0 |
| | $MoSi_2$ breakdown: Laves phase % | mass ratio (%) | 3.1 | 3.1 | 3.3 |
| | | vol./area rat. (%) | 2.6 | 2.6 | 2.8 |
| | μ phase % | mass ratio (%) | 28.8 | 28.8 | 22.0 |
| | | vol./area rat. (%) | 24.3 | 24.3 | 17.4 |
| | R phase and other silicides % | mass ratio (%) | 20.0 | 20.0 | 35.4 |
| | | vol/area rat. (%) | 27.1 | 27.1 | 44.8 |
| Particle aggregate | manufacturing method | | cold spraying | cold spraying | cold spraying |
| | base mat. particles | area ratio (%) | 83.8 | 84.1 | 81.6 |
| | hard particles | area ratio (%) | 16.0 | 15.1 | 18.0 |
| | pores | area ratio (%) | 0.2 | 0.8 | 0.4 |
| Wear test | valve seat wear amount (μm) | | 58.8 | 56.3 | 39.7 |
| | valve face wear amount (μm) | | 1.3 | 1.5 | 1.5 |
| | Remarks | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | | |

| | | | Example 4 | Example 5 |
|---|---|---|---|---|
| Base mat. part. | composition (wt %) | | Cu—20Ni—0.7Si | Fe—3Mo |
| Hard particles | composition (wt %) | | Fe—35Mo—3Si | Fe—35Mo—3Si |
| | manufacturing method | | water atomization | crushing |
| | cooling rate (K/sec) | | ~$10^4$ | $10^{-1}$ to $10^0$ |
| | particle size | | −500 mesh | −100 mesh |
| | percentage of parent phase | mass ratio (%) | 39.3 | 52.0 |
| | | vol./area rat. (%) | 35.1 | 54.3 |
| | percentage of $MoSi_2$ | mass ratio (%) | 60.7 | 48.0 |
| | | vol./area rat. (%) | 65.0 | 45.7 |
| | $MoSi_2$ breakdown: Laves phase % | mass ratio (%) | 3.3 | 6.0 |
| | | vol./area rat. (%) | 2.8 | 6.5 |
| | μ phase % | mass ratio (%) | 22.0 | 42.0 |
| | | vol./area rat. (%) | 17.4 | 39.2 |
| | R phase and other silicides % | mass ratio (%) | 35.4 | 0 |
| | | vol/area rat. (%) | 44.8 | 0 |
| Particle aggregate | manufacturing method | | cold spraying | sintering |
| | base mat. particles | area ratio (%) | 80.8 | 80.5* |
| | hard particles | area ratio (%) | 18.5 | |
| | pores | area ratio (%) | 0.7 | 19.5 |
| Wear test | valve seat wear amount (μm) | | 31.6 | 25.2 |
| | valve face wear amount (μm) | | 0.7 | 1.8 |
| | Remarks | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | |

| | | | Example 6 | Example 7 |
|---|---|---|---|---|
| Base mat. part. | composition (wt %) | | Cu—3Ni—0.7Si | Cu—3Ni—0.7Si |
| Hard particles | composition (wt %) | | Fe—33.5Mo—2.39Si | Fe—40Mo—8Cr—2.5Si |
| | manufacturing method | | gas atomization | gas atomization |
| | cooling rate (K/sec) | | ~$10^2$ | ~$10^2$ |
| | particle size | | −350 mesh | −350 mesh |
| | percentage of parent phase | mass ratio (%) | 61.3 | 25.5 |
| | | vol./area rat. (%) | 59.6 | 20.8 |
| | percentage of $MoSi_2$ | mass ratio (%) | 38.7 | 74.5 |
| | | vol./area rat. (%) | 40.4 | 79.2 |
| | $MoSi_2$ breakdown: Laves phase % | mass ratio (%) | 11.7 | 13.9 |
| | | vol./area rat. (%) | 10.2 | 10.0 |
| | μ phase % | mass ratio (%) | 11.5 | 0 |
| | | vol./area rat. (%) | 8.6 | 0 |
| | R phase and other silicides % | mass ratio (%) | 15.5 | 60.6 |
| | | vol/area rat. (%) | 21.6 | 69.2 |

TABLE 2-continued

| | | | | |
|---|---|---|---|---|
| Particle | manufacturing method | | cold spraying | cold spraying |
| aggregate | base mat. particles | area ratio (%) | 82.7 | 82.5 |
| | hard particles | area ratio (%) | 16.3 | 16.8 |
| | pores | area ratio (%) | 1.0 | 0.7 |
| Wear test | valve seat wear amount (μm) | | 20.1 | 18.0 |
| | valve face wear amount (μm) | | 1.6 | 1.4 |
| | Remarks | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | |

TABLE 3

| | | | Example 8 | Example 9 | Example 10 |
|---|---|---|---|---|---|
| Base mat. part. | composition (wt %) | | Cu—3Ni—0.7Si | Cu—3Ni—0.7Si | Cu—3Ni—0.7Si |
| Hard particles | composition (wt %) | | Fe34Mo—4.7Si | Fe—35Mo—4.8Si | Fe—34Mo—6.4Si |
| | manufacturing method | | water atomization | gas atomization | water atomization |
| | cooling rate (K/sec) | | $\sim 10^4$ | $\sim 10^2$ | $\sim 10^4$ |
| | particle size | | −350 mesh | −350 mesh | −350 mesh |
| | percentage of parent phase | mass ratio (%) | 27.4 | 25.1 | 21.9 |
| | | vol./area rat. (%) | 27.1 | 24.8 | 22.4 |
| | percentage of $MoSi_2$ | mass ratio (%) | 72.6 | 74.9 | 78.1 |
| | | vol./area rat. (%) | 72.9 | 75.2 | 77.6 |
| | $MoSi_2$ breakdown: Laves phase % | mass ratio (%) | 54.7 | 44.6 | 67.4 |
| | | vol./area rat. (%) | 48.1 | 40.2 | 62.1 |
| | μ phase % | mass ratio (%) | 0 | 0 | 0 |
| | | vol./area rat. (%) | 0 | 0 | 0 |
| | R phase and other silicides % | mass ratio (%) | 17.9 | 30.3 | 10.7 |
| | | vol./area rat. (%) | 24.8 | 35.0 | 15.5 |
| Particle | manufacturing method | | cold spraying | cold spraying | cold spraying |
| aggregate | base mat. particles | area ratio (%) | 84.4 | 84.9 | 85.1 |
| | hard particles | area ratio (%) | 15.3 | 14.5 | 14.5 |
| | pores | area ratio (%) | 0.3 | 0.6 | 0.4 |
| Wear test | valve seat wear amount (μm) | | 15.5 | 13.0 | 12.1 |
| | valve seat wear amount (μm) | | 1.3 | 0.8 | 1.0 |
| | Remarks | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | | |

| | | | Example 11 | Example 12 |
|---|---|---|---|---|
| Base mat. part. | composition (wt %) | | Cu—20Ni—0.7Si | Fe—3Mo |
| Hard particles | composition (wt %) | | Fe—35Mo—9.5Si | Fe—35Mo—10Si |
| | manufacturing method | | gas atomization | crushing |
| | cooling rate (K/sec) | | $\sim 10^2$ | $10^{-1}$ to $10^0$ |
| | particle size | | −350 mesh | −100 mesh |
| | percentage of parent phase | mass ratio (%) | 23.1 | 38.8 |
| | | vol./area rat. (%) | 23.6 | 37.1 |
| | percentage of $MoSi_2$ | mass ratio (%) | 76.9 | 61.2 |
| | | vol./area rat. (%) | 76.4 | 62.9 |
| | $MoSi_2$ breakdown: Laves phase % | mass ratio (%) | 76.9 | 61.2 |
| | | vol./area rat. (%) | 76.4 | 62.9 |
| | μ phase % | mass ratio (%) | 0 | 0 |
| | | vol./area rat. (%) | 0 | 0 |
| | R phase and other silicides % | mass ratio (%) | 0 | 0 |
| | | vol./area rat. (%) | 0 | 0 |
| Particle | manufacturing method | | cold spraying | sintering |
| aggregate | base mat. particles | area ratio (%) | 83.4 | 82.0* |
| | hard particles | area ratio (%) | 15.8 | |
| | pores | area ratio (%) | 0.8 | 18.0 |
| Wear test | valve seat wear amount (μm) | | 11.5 | 19.3 |
| | valve seat wear amount (μm) | | 0.9 | 1.9 |
| | Remarks | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | |

TABLE 3-continued

| | | | Example 13 | Example 14 |
|---|---|---|---|---|
| Base mat. part. | composition (wt %) | | Cu—3Ni—0.7Si | Cu—3Ni—0.7Si |
| Hard particles | composition (wt %) | | Fe—35Mo—13Si—8Cr | Fe—40Mo—15Si |
| | manufacturing method | | gas atomization | gas atomization |
| | cooling rate (K/sec) | | $\sim 10^2$ | $\sim 10^2$ |
| | particle size | | −350 mesh | −350 mesh |
| | percentage of parent phase | mass ratio (%) | 17.8 | 14.2 |
| | | vol./area rat. (%) | 16.6 | 13.0 |
| | percentage of $MoSi_2$ | mass ratio (%) | 82.2 | 85.8 |
| | | vol./area rat. (%) | 83.4 | 87.0 |
| | $MoSi_2$ breakdown Laves phase % | mass ratio (%) | 80.2 | 85.7 |
| | | vol./area rat. (%) | 83.4 | 87.0 |
| | μ phase % | mass ratio (%) | 0 | 0 |
| | | vol./area rat. (%) | 0 | 0 |
| | R phase and other silicides % | mass ratio (%) | 0 | 0 |
| | | vol./area rat. (%) | 0 | 0 |
| Particle aggregate | manufacturing method | | cold spraying | cold spraying |
| | base mat. particles | area ratio (%) | 84.2 | 82.7 |
| | hard particles | area ratio (%) | 15.2 | 16.8 |
| | pores | area ratio (%) | 0.6 | 0.5 |
| Wear test | valve seat wear amount (μm) | | 23.2 | 31.8 |
| | valve seat wear amount (μm) | | 2.2 | 3.2 |
| | Remarks | | Area ratio including graphite particles. Cannot measure area ratio due to solid-phase diffusion via sintering. Powder containing mixture of base material particles, hard particles, and graphite particles in ratio of 84.5:15.0:0.5 (wt %) was used. | |

It is clear from a comparison of comparative examples 1 to 7 and examples 1 to 14 that when the hard particles contain 35% by area or more of molybdenum silicide, wear resistance improves, which is comparable to a component containing cobalt-based hard particles Tribaloy® T-400 having a hard phase.

It is clear from a comparison of examples 6 to 11 that as the Si content of the hard particles increases, the amount of molybdenum silicide also increases, and wear resistance improves.

In comparative example 2, the Si content was low, and molybdenum silicide did not sufficiently precipitate.

Although example 6 has less molybdenum silicide than examples 1 and 2, example 6 has exceptional wear resistance, and it is therefore clear that wear resistance improves when there is a large amount of Laves-phase molybdenum silicide.

The invention claimed is:

1. A sliding member comprising:

at least one surface having a particle aggregate of base material particles and hard particles, wherein the hard particles are iron-based alloy particles containing molybdenum silicide in an amount of 35% to 90% by area.

2. The sliding member according to claim 1, wherein the hard particles contain, in order from the most abundant element in percentage by mass, iron (Fe), molybdenum (Mo), and silicon (Si), and wherein the silicon content is 2.3% to 16% by mass.

3. The sliding member according to claim 1, wherein the molybdenum silicide includes a Laves phase.

4. The sliding member according to claim 3, wherein the hard particles contain 2% to 90% by area of the Laves phase.

5. The sliding member according to claim 3, wherein the hard particles contain 10% to 85% by area of the Laves phase.

6. The sliding member according to claim 3, wherein the hard particles contain 30% to 80% by area of the Laves phase.

7. The sliding member according to claim 1, wherein the base material particles are copper-based alloy particles or iron-based alloy particles.

8. The sliding member according to claim 1, wherein the base material particles and the hard particles are sprayed onto a substrate to deform and laminate.

9. The sliding member according to claim 1, wherein the base material particles and the hard particles are sintered.

10. An internal combustion engine comprising the sliding member according to claim 1.

* * * * *